US006797459B2

(12) United States Patent
Shirata

(10) Patent No.: US 6,797,459 B2
(45) Date of Patent: Sep. 28, 2004

(54) SILVER HALIDE EMULSION AND METHOD OF PREPARING THE SAME

(75) Inventor: Masashi Shirata, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/103,853

(22) Filed: Mar. 25, 2002

(65) Prior Publication Data

US 2003/0068593 A1 Apr. 10, 2003

(30) Foreign Application Priority Data

Mar. 26, 2001 (JP) ..... P. 2001-087689

(51) Int. Cl.[7] ..... G03C 1/035; G03C 1/015
(52) U.S. Cl. ..... 430/567; 430/568; 430/569
(58) Field of Search ..... 430/567, 568, 430/569

(56) References Cited

U.S. PATENT DOCUMENTS 5,604,086 A 2/1997 Reed et al.
5,695,923 A 12/1997 Irving et al.
5,698,387 A 12/1997 Reed et al.

*Primary Examiner*—Richard L. Schilling
(74) *Attorney, Agent, or Firm*—Sughrue Mion, PLLC

(57) ABSTRACT

A silver halide emulsion is disclosed, comprising silver halide grains which each have a host tabular grain part and a part grown on the outside thereof, wherein in said host tabular grains parts, at least 50% of total projected area of the silver halide grains are accounted for by silver halide tabular grains having {111} main surfaces, and said silver halide grains comprises the main surface of the host tabular grain part subjected to junction with high-iodide epitaxial phases comprising silver halide containing at least 97 mole % of silver iodide and the lateral face of the host tabular grain part comprises silver halide having an iodide content of substantially 5 mole % or below; and a method of preparing a silver halide photographic emulsion is disclosed, comprising silver halide grains which each have a host tabular grain part and a part grown on the outside thereof.

8 Claims, No Drawings

SILVER HALIDE EMULSION AND METHOD OF PREPARING THE SAME

FIELD OF THE INVENTION

The present invention relates to a light-sensitive silver halide emulsion, particularly to a tabular silver halide grain emulsion for photography.

BACKGROUND OF THE INVENTION

In general, silver halide emulsions containing tabular silver halide grains (referred to as "tabular grains" hereinafter), especially thin tabular grains, have the following advantages in their photographic characteristics:

(1) since the surface area/volume ratios (referred to as "specific surface areas" hereinafter) of tabular grains are great and large quantities of sensitizing dyes can be adsorbed to the tabular grain surfaces, the emulsions have high spectral sensitization sensitivities as compared with their intrinsic sensitivities, (2) when emulsions containing tabular grains are coated on a support and dried, the grains are aligned in parallel with the support surface, so the coating layers can be made thin and the resulting photographic light-sensitive material is improved in sharpness, (3) since little scattering of light is caused by tabular grains, images of high resolution is obtained, and (4) since the tabular grains have low sensitivity to blue light, using them in a green-sensitive or a red-sensitive layer enables removal of an yellow filter from the emulsion layer. Therefore, such emulsions have so far been used in commercially available high-speed light-sensitive materials.

In Japanese Patent Publication Nos. 44132/1994 and 16015/1993 are disclosed the tabular emulsion grains having aspect ratios of at least 8. The term "aspect ratio" as used herein is defined as a diameter/thickness ratio of each individual grain. The diameter of each individual grain refers to the diameter of a circle having the same area as the grain's projected area determined by observation under a microscope or an electron microscope. The thickness of each individual grain refers to the distance between two parallel surfaces forming the tabular grain.

Further, Japanese Patent Publication No. 36374/1992 discloses the color photographic light-sensitive material which contains tabular grains having a thickness of less than 0.3 $\mu$m and a diameter of at least 0.6 $\mu$m in at least either of the green-sensitive and red-sensitive emulsion layers and thereby achieves improvements in sharpness, sensitivity and graininess. In recent years, on the other hand, silver halide light-sensitive materials have advanced in sensitivity increase and format reduction, and color photosensitive materials having higher sensitivities and improved image qualities have been desired strongly. Therefore, silver halide grain emulsions having higher sensitivity and more excellent graininess have been required. However, conventionally known tabular silver halide emulsions are insufficient to meet these requirements, and so stepped-up improvements in photographic characteristics are expected.

Additionally, tabular grains having greater aspect ratios can have the greater specific surface areas, and so they can make good use of the above-described advantages of tabular grains.

However, tabular grains enable adsorption of sensitizing dyes in greater amounts but, at the same time, have a defect of reflecting a greater proportion of light incident thereon.

Therefore, it is difficult to obtain an increase in light absorption as expected.

On the other hand, silver iodide exhibits a face centered cubic crystal lattice structure under very high level of pressure (3,000 to 4000 times the atmospheric pressure) alone. The silver halide of this structure is referred to as $\sigma$-phase AgI, and irrelevant to silver halide photography. Normally, the most stable crystal structure of silver iodide is a hexagonal wurtzite type, and the silver iodide of this crystal structure is generally referred to as $\beta$-phase AgI. The photographically useful, sufficiently stable, secondary crystal lattice structure of silver iodide is a face centered cubic zinc-blending type crystal structure, and the silver iodide of this structure is generally referred to as $\gamma$-phase AgI. Silver halide emulsions containing $\beta$-phase AgI, $\gamma$-phase AgI and AgI having a mixture of these phases, respectively, have been made. The fourth crystallographic form of silver iodide is $\alpha$-phase, namely a body centered cubic structure. According to the description in T. H. James, *The Theory of Photographic Process,* page 1, the formation of this crystal structure requires the temperature of 146° C. And the bright yellow silver iodide reported in U.S. Pat. No. 4,672,026 to Daubendiek is believed to be $\alpha$-phase AgI. (The descriptions at pages 1 to 5 of the book compiled by James relate to these crystal lattice structures and these studies.)

High-iodide silver halide grains have a marked advantage over silver halide grains of face centered cubic crystal lattice structure in that they have higher intrinsic absorption in the short blue portion (400 to 450 nm) of spectrum. In particular, high-iodide silver halide is generally identified as silver halide that exhibits an absorption peak at 425 nm missing in the absorption spectra of silver chloride and silver bromide, has a crystal lattice structure different from the face-centered cubic crystal structure and contains at least 97 mole % of iodide (high-iodide), based on total silver, namely only a minute amount of bromide and/or iodide. U.S. Pat. No. 4,184,878 to Maternaghan is an example of the high-iodide silver halide emulsion.

However, high-iodide silver halide grains are difficult to sensitize and develop with commercial developers, and these difficulties greatly inhibit their use for latent image formation.

Under these circumstances, it has been proposed from time to time to join a high-iodide phase to the surface of tabular silver halide grains having a face-centered hexagonal crystal lattice structure with the aim of exploiting both the advantages of tabular grains and high absorptivity of silver iodide, and further with the intention of supplementing defects of tabular grains and silver iodide.

U.S. Pat. No. 4,471,050 discloses selective attachment of nonisomorphic silver salts to edges of silver halide host grains without recourse to any additional site director. In these non-isomorphic silver salts are included silver thiocyanate, $\beta$-phase AgI (exhibiting a hexagonal wurtzite type crystal structure), $\gamma$-phase AgI (exhibiting a zinc-blending type crystal structure), silver phosphates (including meta- and pyrophosphates) and silver carbonate. None of these non-isomorphic silver salts exhibit the face-centered cubic crystal structure of the type which is observed in photographic silver halides (namely the isomorphic face-centered cubic crystal structure of rock salt type). In fact, the sensitivity increase produced by nonisomorphic silver salt epitaxy was smaller than that attained by comparative isomorphic silver salt epitaxial sensitization.

Japanese Patent Application (Laid-Open) No. 2000-2959 discloses silver halide tabular grains having, on the main surfaces of {111} tablet having a thickness of 0.1 $\mu$m or below, ruffled surfaces formed of minute protrusions containing 10 mole % or less of iodide and having projected area diameters of 0.15 μm or below. The present invention can provide tabular silver halide grains enabling adsorption of sensitizing dyes in an increased amount and reduced reflection of light since the grains are increased in specific surface area without decrease in thickness. However, the objective for incorporating silver iodide in those protrusions was not to improve absorption of light, but to maintain structural stability of the protrusions. Therefore, it is hard to say that those tabular grains made good use of photographically useful properties of silver iodide, including highly efficient absorption of light.

U.S. Pat. No. 5,604,086 is one illustrative instance of emulsions containing tabular grains of rock salt-type face-centered cubic lattice structure which have epitaxially grown high-iodide silver halide crystals on the main surfaces thereof. Therein, it is disclosed that the tabular grains are composite grains having epitaxial phases of high iodide contents on the main surfaces of {111} tabular grains or {100} tabular grains, and the high-iodide epitaxial phases form discrete plates having triangular and hexagonal boundaries and can yield a great improvement in absorptivity of blue light. However, those tabular grains have problems that the epitaxial phases deposited are distributed unevenly among the grains, and besides, the high-iodide phases are present on the lateral faces (i.e., the side surface) also to retard the rate of development.

SUMMARY OF THE INVENTION

Therefore, an object of the present invention is to achieve a sensitivity increase by utilizing strong absorption of the blue light having a short wavelength by high-iodide phase, and besides, to provide a silver halide emulsion ensuring fast ratye of development.

Ideally, a silver halide emulsion having a high sensitivity/fog ratio can be provided by depositing high-iodide epitaxy on the main surfaces and lowering an iodide content in the lateral faces (i.e., the side surface).

More specifically, the object described above is attained with the following embodiments 1 to 16 of the present invention:

1. A silver halide emulsion comprising silver halide grains, at least 50% of total projected area of the silver halide grains being accounted for by silver halide tabular grains having {111} main surfaces (also referred to as "host tabular grains" hereinafter), wherein the main surface of the tabular grains are subjected to junction with epitaxial phases formed of silver halides comprising at least 97 mole % of silver iodide (high-iodide epitaxial phases) and the lateral face of the host tabular grain comprises silver halide having silver iodide contents of substantially 5 mole % or below.
2. A method of preparing a silver halide emulsion as described in Embodiment 1, comprising sequentially joining high-iodide epitaxial phases to host tabular grains and depositing silver halide phases having a low silver iodide content intentionally on lateral faces of the host tabular grains.
3. The silver halide emulsion as described in Embodiment 1, wherein the inner part occupying less than 80% of the total silver from the center in the host tabular grain part has an average silver iodide content of at least 5 mole % and an outer part which surrounds the inner part has an average silver iodide content of 5 mole % or less, and a difference in silver iodide content between the inner part and the outer part is in the range of 0 to 10 mole %.
4. The silver halide emulsion as described in Embodiment 1, wherein the host tabular grains comprise high silver iodide-content surface layers and low silver iodide-content surface layers formed on the fringes of the high silver iodide-content surface layers, and further the high silver iodide-content surface layers and the low silver iodide content surface layers are exposed at the main surfaces in an areal ratio from 2:1 to 9:1 (in other words, a ratio of the area of the high silver iodide-content surface layers exposed at the main surfaces to the area of the low silver iodide-content surface layers exposed at the main surfaces is from 2:1 to 9:1).
5. The silver halide emulsion as described in any one of Embodiments 1, 3 and 4, wherein the host tabular grains each contain dislocations formed during the grain growth in an outer region of each individual main surface which is situated far from the main surface's center by 80% or more of a distance between the center and the periphery of the main surface, and further the host tabular grains containing dislocations make up at least 90% of the total grains.
6. The silver halide emulsion as described in any one of Embodiments 1 and 3 to 5, wherein the silver iodide contents in the lateral faces are substantially 1 mole % or below.
7. The silver halide emulsion as described in any one of Embodiments 1 and 3 to 6, wherein the host tabular grains have projected area diameters of at least 2 μm.
8. The silver halide emulsion as described in any one of Embodiments 1 and 3 to 7, wherein at least 90% of total projected area of the host tabular grains are accounted for by tabular grains having aspect ratios of at least 2.
9. The silver halide emulsion as described in any one of Embodiments 1, and 3 to 8, wherein at least 60% of the epitaxial phases are formed of silver halides containing at least 97 mole % of silver iodide.
10. The silver halide emulsion as described in any one of Embodiments 1 and 3 to 9, wherein the high-iodide epitaxial phases account for at least 10 mole % of total amount of silver.
11. The silver halide emulsion as described in any one of Embodiments 1 and 3 to 10, wherein an occupying areal proportion of the high-iodide epitaxial phases subjected to junction onto the main surfaces of each host tabular grain is within ±10% of an average occupying areal proportion for all the grains.
12. The silver halide emulsion as described in any one of Embodiments 1 and 3 to 11, wherein the silver halide grains are subjected to reduction sensitization.
13. The silver halide emulsion as described in any one of Embodiments 1 and 3 to 12, wherein the silver halide grains contain a photographically useful dopant.
14. The silver halide emulsion as described in any one of Embodiments 1 and 3 to 13 and a method of preparing the emulsion, wherein grain growth of at least 10% of the host tabular grains, based on silver, is performed in a vessel by adding thereto fine grains of silver iodobromide formed in a vessel other than the vessel for the grain growth.
15. The silver halide emulsion as described in any one of Embodiments 1 and 3 to 14, wherein the silver halide grains have a corner portion subjected to junction with epitaxial phases of silver halide having iodide contents of substantially 10 mole % or below.

16. The method of preparing a silver halide emulsion as described in Embodiment 2, wherein the high-iodide epitaxial phases are formed under the following conditions (1) and/or (2) and then silver halide phases with low silver iodide contents are disposed on the lateral faces of the tabular grains:

(1) pAg is maintained to less than 6.4

(2) a compound having (100) face selectivity is present.

DETAILED DESCRIPTION OF THE INVENTION

The present invention is illustrated below in further detail.

With respect to the present tabular-grain part (referred to as "host tabular grain"), the main surfaces thereof are {111} faces. Tabular silver halide grains which each have one twin plane or two or more parallel twin planes are generically called "tabular grains having {111} faces as main surfaces". The term twin plane means the {111} face with respect to which all pairs of lattice ions on opposite sides are mirror images of each other. When viewed from above, these tabular grains have the shape of a triangle or a hexagon, or the shape rounded off in the corners of a triangle or hexagon. The triangular, hexagonal or rounded-off tabular grains each have mutually parallel outer surfaces in the shape of a triangle or hexagon, or in the shape rounded off in the corners of a triangle or hexagon.

The epitaxial phases according to the present invention are present on the main surfaces of host tabular grains, and besides, these phases have high iodide contents of at least 97 mole % (sometimes they are abbreviated as "high-iodide epitaxial phases"). Silver iodide has high shape stability because of low solubility, and can achieve a gain in absorption of blue light. When silver halides other than silver iodide are contained in large amounts, optical absorptivity is lowered. The mixing of other halides into the high-iodide epitaxial phases is a consequence of depositing high-iodide epitaxial phases by introduction of silver and iodide ions into a host tabular grain emulsion in the presence of bromide and/or chloride ions in a state of equilibrium with the host tabular grains. Minimizing the mixing of halides other than iodide into high-iodide epitaxial phases is effective in gaining highly effective optical absorption. It is favorable for this purpose that at least 60% of the epitaxial phases formed are made up of silver halides having an iodide content of at least 97 mole %.

When the present emulsion (i.e., the emulsion of the present invention) is exposed to light of short wavelengths from 400 to 450 nm, the photons are absorbed by not only tabular grains but also a number of high-iodide epitaxial parts present on the grains' main surfaces. The epitaxial phases are present on the topside and the underside of each tabular grain, and so from 60 to 70% of the total photons of short blue light can be absorbed at the high-iodide epitaxial parts present on both topside and underside. In the case where the tabular grains have high-iodide epitaxial parts only on their fringe areas and vertexes, photons capable of being absorbed thereby becomes very scarce. Therefor, it is undesirable to form the high-iodide epitaxial phases only on the fringe areas of main surfaces.

In addition, in the case where the high-iodide epitaxial phases are subjected to junction to the fringe areas and lateral faces (i.e., side surfaces) of tabular grains, development is markedly inhibited, and optical absorption by the high-iodide epitaxial phases cannot be reflected in sensitivity. In order to improve these conditions in the present invention, many high-iodide epitaxial phases are formed on the main surfaces of host tabular grains and iodide contents in the lateral faces of tabular grains are controlled to 5 mole % or below, preferably 2 mole % or below. Thus, the problems about development and optical absorption have been resolved.

More specifically, the development trouble is improved in the present invention through success in controlling lateral iodide contents to 5 mole % or below by disposing low-iodide silver halide phases on the lateral faces of host tabular grains after junction of high-iodide epitaxial phases. For the control of lateral iodide content, it is important to deposit high-iodide epitaxial phases on the central areas of host tabular grains' main surfaces, but not to deposit high-iodide epitaxial phases on the fringe areas of host tabular grains' main surfaces and the host tabular grains' lateral faces, and further to prevent mixed crystallization by dissolution/recrystallization of high-iodide epitaxial phases. Conditions meeting these requirements are described in detail in Examples.

It is appropriate that the present host tabular grains (i.e., the host tabular grains of the present invention) each have a silver iodide content of at least 5 mole %, preferably at least 7 mole %, based on the amount of silver, in a three-dimensional region occupying the central part and containing 80% of the total silver forming each individual grain. In the outside of this region, the suitable silver iodide content is 5 mole % or below, preferably 2 mole % or below, on a silver bases. The suitable difference in silver iodide content between these two regions is from 0 to 10 mole %. Herein, the center of each grain means the position at which there is the center of gravity of each grain. By having such a silver iodide distribution, the host tabular grains in themselves can gain absorption of blue light in addition to high-iodide epitaxial phases, resulting in achievement of high optical absorption.

In the present invention, it is desirable to use host tabular grains made up of high-iodide surface and low-iodide surface layers formed on fringes of the high-iodide surface layers. The suitable silver iodide contents in the high-iodide surface layers of the host tabular grains is at least 5 mole %, preferably at least 10 mole %, while those in the low-iodide surface layers are not more than 3 mole %, preferably not more than 1 mole %. And it is appropriate that the areal ratio between those two surface layers exposed at each main surface (the ratio of the area of the high-iodide surface layer exposed at each main surface to the area of the low-iodide surface layer exposed at each main surface) be from 2:1 to 9:1. The high-iodide epitaxial phases are deposited preferentially on the high-iodide surface layers. As a result, it becomes possible to control the iodide contents in the fringe areas and lateral faces to 5 mole % or below. After deposition of high-iodide epitaxial phases on the host grains, silver halide phases having low silver iodide contents are further disposed on the lateral faces of the host tabular grains, and enable an increase in development speed.

In the present invention, the lateral silver iodide content is determined by the following method.

The tabular silver halide grains in a silver halide photographic emulsion are extracted through gelatin degradation with a proteolytic enzyme, and then enveloped in methacrylic resin, and further cut into slices about 500 Å in thickness by means of a diamond cutter. From these slices are picked out slices having visible fault planes perpendicular to parallel main surface pairs of tabular silver halide grains. As to each of the tabular silver halide grains whose fault planes are visible, the silver halide layer portion extending from the lateral surface to an inward distance of 100 Å is examined by spot analysis performed in accordance with analytical electron microscopy wherein the spot diameter is narrowed down to 50 Å, preferably 20 Å, thereby determining the lateral silver iodide content.

Further, it has been discovered that the present host tabular grains can produce greater effects by containing dislocation lines generated during the growth thereof. And it is appropriate for the host tabular grains to contain the dislocation lines in an outer region of each individual main surface which is situated far from the main surface's center by 80% of a distance between the center and the periphery of the main surface. Description of techniques to introduce dislocation lines into silver halide grains under control can be found in Japanese Patent Application (Laid-Open) No. 230238/1988. According to this document, dislocations can be introduced by forming specified phases having high silver iodide contents in the interior of tabular silver halide grains having an average grain diameter/grain thickness ratio of at least 2, and then covering these phases on the exterior with phases having iodide contents lower than the phases having high silver iodide contents. The introduction of dislocations can produce various effects, including a rise insensitivity, an improvement in keeping quality, an increase in latent-image stability and a reduction of pressure mark. In the present invention disclosed in the document cited above, the dislocations are introduced predominantly on the edges of tabular grains. On the other hand, U.S. Pat. No. 5,238,796 describes the tabular grains in the center part of which dislocations are introduced. In this document, it is disclosed that dislocations are introduced by epitaxially depositing silver chloride or chlorobromide on normal crystal grains and subjecting the epitaxial deposits to physical ripening and/or halogen conversion. By the introduction of these dislocations, effects of increasing the sensitivity and reducing the pressure mark can be achieved. The dislocation lines contained in silver halide grains can be observed by the direct method using a transmission electron microscope at a low temperature as described in J. F. Hamilton, *Photo. Sci. Eng.,* 1967, 11, 57 and T. Shiozawa, *J. Soc. Photo Sci., JAPAN,* 1972, 35, 213. More specifically, silver halide grains extracted from an emulsion while exercising care to avoid applying a pressure on the level of causing dislocations to the grains are put on a mesh for observation with an electron microscope, and the observation of these grains by transmission method is carried out under cooling so as to prevent damage (printout) caused by electron beams. Therein, as the grains are more resistant to transmission of electron beams the greater they are in thickness, the use of an electron microscope of higher pressure type (200 keV or higher with respect to the thickness of 0.25 $\mu$m) enables the clearer observation. From the photographs of grains taken in the above-described manner can be determined the positions and the number of dislocation lines present in each individual grain viewed from the plane perpendicular to the main surface.

The suitable diameter (equivalent circle diameter) of the present host tabular grains is from 2 $\mu$m to 20.0 $\mu$m, preferably from 3.0 $\mu$m to 10 $\mu$m. Silver halide grains having projected-area diameters of at least 2.0 $\mu$m account for at least 50% of the total projected area. The suitable equivalent sphere diameter is from 1.0 $\mu$m to 5.0 $\mu$m, preferably from 1.2 $\mu$m to 3 $\mu$m. The term "equivalent sphere diameter" as used herein means the diameter of a sphere equivalent in volume to each individual grain. In addition, the suitable aspect ratio is from 2 to 50, preferably from 10 to 30. The term "aspect ratio" as used herein is defined as a value obtained by dividing the projected-area diameter of a grain by the grain's thickness.

As the present host tabular grains, it is advantageous to use tabular grains which are monodisperse with respect to the distribution of their equivalent circle diameters. In regard to the monodisperse distribution, Japanese Patent Application (Laid-Open) No. 11928/1988 and Japanese Patent Publication No. 61205/1993 disclose the monodisperse hexagonal tabular grains, and Japanese Patent Application (Laid-Open) No. 131541/1989 discloses the monodisperse circular tabular grains. Further, Japanese Patent Application (Laid-Open) No. 838/1990 discloses the emulsion wherein at least 95%, on a projected-area basis, of the total silver halide grains are tabular grains which each have two twin planes parallel to the principal surfaces and the size distribution of these tabular grains is monodisperse. And EP-A-514742 discloses the tabular grain emulsion which is prepared using a polyalkylene oxide block copolymer and has a variation coefficient of 10% or below with respect to the grain size distribution.

As a method of preparing host tabular grains used in the present invention, or tabular grains of the type which have {111} main surfaces, the methods disclosed in U.S. Pat. Nos. 4,434,226, 4,439,520, 4,414,310, 4,433,048, 4,414,306 and 4,459,353, and Japanese Patent Application (Laid-Open) Nos. 179226/1997 and 92057/2001 can be adopted. In these references, the techniques for using those grains are also disclosed. Further, as disclosed in Japanese Patent Application (Laid-Open) No. 214331/1994, tabular grains can be formed by once forming seed crystals by nucleation, and then preparing the seed crystals grow by adding silver salt and halide solutions under conditions that pH and pAg values are adjusted so as to fit the grain growth.

Dyes ideal for use in the present invention are blue-sensitive dyes (dyes sensitive to light of wavelengths ranging from 400 to 500 nm) which each show a maximal absorption peak having a half width of about 100 nm in the region of 400 to 500 nm when they are applied to general tabular grains. However, dyes providing the half-peak width of 100 nm are little known. In other words, there are no dyes whose absorption peaks have half widths equivalent to the wavelength spread of the blue spectrum. In the case of general blue-sensitive dyes, the half-peak width thereof is 50 nm or below. When one or more of dyes having maximal absorption at the longer wavelengths is combined with the present emulsion, blue absorption with higher efficiency can be obtained over the entire blue region of spectrum because the absorption peak of high-iodide epitaxial phases is 427 nm.

When sensitizing dyes are not present, short blue photons are absorbed in high-iodide epitaxial parts and photohole-photoelectron pairs are formed. The photoelectrons migrate freely into host tabular grains via junctions between the host tablet and the high-iodide epitaxial phases, while the photoholes are trapped in the high-iodide epitaxial parts. Therefore, photoholes and photoelectrons are separated and re-coupling between them is inhibited. Thus, the high-iodide epitaxial phases can contribute to supply of many photoelectrons for latent-image formation; as a result, they can function so as to enhance the sensitivity of emulsion grains as a whole.

Elevation of short blue light absorptivity can be achieved by increasing the thickness of the high-iodide epitaxial phases and the area taken up by these phases. For a further rise in light absorptivity, it is desirable to increase the proportion of the high-iodide epitaxial phases present on the main surfaces of host tabular grains. More specifically, it is appropriate that the high-iodide epitaxial phases account for at least 25%, preferably at least 50%, ideally at least 60%, of the area of main surfaces. In addition, the high-iodide epitaxial phases account for at least 10 mole %, preferably at least 15 mole %, of total amount of silver.

Furthermore, the suitable occupying areal proportion of the high-iodide epitaxial phases in each individual grain is within ±10%, preferably ±8%, of an average occupying areal proportion for all the grains. By such an areal proportion control, a further improvement in image sharpness can be made.

Since the present epitaxial phases contain silver iodide in high proportions, the solubility thereof is lowered and the shape thereof is kept stable, and further the iodide ions present on the surface of epitaxy can enhance adsorption of sensitizing dyes.

A main reason why many high-iodide epitaxial phases are formed on the main surfaces of host tabular grains as in the present invention is thought to be a difference in lattice parameter between the host grain component and the high-iodide epitaxial phase component. The lattice parameters of silver halide compositions are described, e.g., in T. H. James *The Theory of the Photographic Process,* 4 th ed., pp. 3–4, Macmillan Publishing Co., Inc. (1977). Since a great difference in lattice parameter between a host tabular grain and a high-iodide epitaxial phase has an effect on epitaxial growth in the plane direction of the host tablet, epitaxial growth in the other directions takes place after the growth in the plane direction proceeds until the time when the relief of structural distortion becomes impossible or in parallel with the growth in the plane direction. Therefore, it is thought that many high-iodide epitaxial phases are formed on the main surfaces of host tabular grains. Further, the smaller the difference in lattice parameter between the main surface of a host tabular grain and a high-iodide epitaxial phase, namely the higher the silver iodide content in the main surface of a host tabular grain, the easier the formation of the high-iodide epitaxial phase. This is because the structural distortion can be reduced by narrowing the lattice parameter difference. In addition, the high-iodide epitaxial phases formed on a host portion having a high silver iodide content lose boundaries between neighboring epitaxial phases to result in formation of continuous high-iodide layer over the whole main surface.

In the present invention, it is appropriate that the formation of high-iodide epitaxial phases on the main surfaces of host tabular grains be performed at a silver potential in the range of +30 mV to +160 mV (reference electrode: saturated calomel electrode), preferably from +60 mV to +150 mV. In order to deposit the epitaxial phases specifically on a central part of the main surface, but not on the fringe part and lateral faces, of each individual host tabular grain, it is advantageous to choose a high silver potential. In this case, however, the epitaxial phases deposited lose boundaries between neighboring epitaxial phases and form a continuous high iodide layer. Further, the formation under a high temperature is preferred, and so the formation temperature is adjusted to the range of 50° C. to 80° C., preferably 55° C. to 65° C. Although the grain formation methods are shown specifically in Examples, potential-controlled double jet methods are used to advantage. The suitable addition speed at the time when high-iodide epitaxial phases are formed is from 0.1 g/min to 0.7 g/min, preferably from 0.2 g/min to 0.6 g/min, based on $AgNO_3$. Although the adjustment to a high potential is effective for increasing the number of high-iodide epitaxial phases formed on the main surface, it causes a loss of boundaries between neighboring epitaxial phases to result in formation of a continuous high iodide layer over the whole main surface.

The present silver halide grains are prepared using gelatin as a protective colloid. As the gelatin, alkali-processed gelatin is in common use. It is favorable in particular to use alkali-processed gelatin having undergone deionization treatment for removal of foreign ions and impurities and ultrafiltration treatment. As examples of usable gelatin besides alkali-processed gelatin, mention may be made of acid-processed gelatin, gelatin of low molecular weight (in the range of 1,000 to $8\times10^4$, such as enzymatically decomposed gelatin, acid- and/or alkali-hydrolyzed gelatin or thermally decomposed gelatin), gelatin of high molecular weight (in the range of $1.1\times10^5$ to $3.0\times10^5$), gelatin with a methionine content of 50 $\mu$mol/g or below, gelatin with a tyrosine content of 20 $\mu$mol/g or below, acid-processed gelatin containing methionine groups reduced in number, gelatin containing methionine groups deactivated by alkylation, and variously modified gelatin as recited below. The gelatin of high molecular weight is disclosed in Japanese Patent Application (Laid-Open) No. 237704/1999, 233962/2001 and 281780/2001. Examples of variously modified gelatin include gelatin whose amino groups are modified, such as phthalated gelatin, succinated gelatin, trimellitated gelatin or pyromellitated gelatin, and gelatin whose carboxylic groups are modified, such as esterified gelatin represented by methyl esterified gelatin, amidated gelatin, and imidazole-modified gelatin such as ethoxyformylated gelatin. These gelatin derivatives may be used alone or as mixtures of two or more thereof. The amount of gelatin used in the step of forming the present grains is from 1 g to 60 g per mole silver, preferably from 3 g to 40 g per mole silver. The suitable gelatin concentration in the step of chemical sensitization in the present invention is from 1 to 100 g/mole silver, preferably 1 to 70 g/mole silver.

In forming the present host tabular grains, grain growth of at least 10% of the host tabular grains, based on silver, though may be conducted adding fine grains of silver iodobromide prepared in advance to a vessel in which the grain growth is carried out, is preferably performed in a vessel while adding thereto fine grains of silver iodobromide continuously formed in a vessel other than the vessel for the grain growth. The size of fine grains of silver iodobromide added is from 0.005 to 0.05 $\mu$m, preferably from 0.01 to 0.03 $\mu$m. The suitable temperature at the time of grain growth is from 60° C. to 90° C., preferably from 70° C. to 85° C.

Improvements in photographic properties matching the described advantages can be realized by chemically sensitizing the host tabular grains, although this chemical sensitization is not essential to carrying out the present invention. It has also proved possible to introduce chemical sensitizers to the host tabular grains together with high iodide epitaxial phases while completely avoiding an increase in the thickness of host tabular grains.

For achieving further improvements in photographic properties by chemical sensitization, it has proved effective to form a second epitaxially crystallized part restrictively on the corners of host tabular grains in addition to joining high-iodide epitaxial phases to the host tabular grains. The suitable amount of silver in the epitaxial part joined to the corners is from 2 to 30%, preferably from 5 to 15%, of the total amount of silver. The suitable chemical composition in the corner epitaxial part may be any of silver chloride, silver chlorobromide, silver chlorobromoiodide, silver iodobromide and silver thiocyanate. Of these compositions, silver chloride, silver chlorobromide and silver chlorobromoiodide are preferred.

In the present invention, it is specifically planned that one or more dopants is incorporated in the crystal lattice structure of either the host tabular grains or the second epitaxial phases limited to the corners. When two or more dopants are incorporated, it is specifically planed to place one dopant in the host tabular grains and another in the second epitaxial phases, thereby avoiding antagonistic effects capable of occurring when dissimilar dopants are present in the same grain region. Any of dopants known to be useful in FCCRS crystal lattice can be incorporated. Photographically useful dopants selected from a wide range of periods and groups in the Periodic Table of Elements have been reported. Examples of conventionally used dopants include ions from the periods 3 to 7 (most commonly the periods 4 to 6) in the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn, Sb, Ba, La, W, Au, Hg, Tl, Pb, Bi, Ce and U. By using dopants, (a) the sensitivity can be increased, (b) high or low intensity reciprocity failure can be reduced, (c) variation of contrast can be increased, decreased or reduced, (d) pressure sensitivity can be lowered, (e) dye desensitization can be decreased, (f) stability can be enhanced (wherein reduction in thermal instability is included), (g) minimum density can be lowered and/or (h) maximum density can be heightened. In some uses, polyvalent metal ions are effective. These metals can be added in the form of salts capable of being dissolved at the time of grain formation, such as ammonium salt, acetate, nitrate, sulfate, phosphate, hydroxide, six-coordinated complex salt and four-coordinated complex salt As examples of such salts, mention may be made of $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4[Ru(CN)_6]$. Ligands of coordination compounds can be selected from halo, aquo, cyano, cyanato, thiocyanato, nitrosil, thionitrosil, oxo and carbonato ligands. These metal compounds may be used alone or as a combination of two or more thereof.

It is preferable that the metal compounds be dissolved in water or an appropriate organic solvent, such as methanol or acetone, and then added. In order to stabilize the solution, a method of adding a water solution of hydrogen halide (e.g., HCl, HBr) or alkali halide (e.g., KCl, NaCl, KBr, NaBr) can be used. Further, if desired, an acid or an alkali maybe added. The metal compounds can be added to a reaction vessel before or during the grain formation. In the other way, the metal compounds may be added continuously during the formation of silver halide grains by adding them to aqueous solutions of water-soluble salt (e.g., $AgNO_3$) or alkali halide (e.g., NaCl, KBr, KI). In addition, a solution of metal salt is prepared independently of the solution of water-soluble salt and the solution of alkali halide, and added continuously in an appropriate stage during the grain formation. And it is also preferred to use various combinations of addition methods.

The chemical sensitization in the present invention can be effected using chalcogen sensitization including sulfur sensitization, selenium sensitization and tellurium sensitization, precious metal sensitization (especially gold sensitization) and reduction sensitization individually or as combinations thereof. In particular, reduction sensitization is effective for the present emulsion.

In the sulfur sensitization, unstable sulfur compounds are used. Such unstable sulfur compounds are described, e.g., in P. Glafkides, *Chimie et Physique Photographique,* 5th ed., Paul Montel (1987), and *Research Disclosure* vol. 307, Item 307105. Specifically, known sulfur compounds, such as thiosulfates (e.g., sodium thiosulfate), thioureas (e.g., diphenylthiourea, triethylthiourea, N-ethyl-N'-(4-methyl-2-thiazolyl) thiourea, dicarboxymethyl-dimethylthiourea and carboxymethyl-trimethylthiourea), thioamides (e.g., thioacetamide), rhodanines (e.g., diethylrhodanine and 5-benzylidene-N-ethyl-rhodanine), phosphine sulfides (e.g., trimethylphosphine sulfide), thiohydantoins, 4-oxo-oxazolidine-2-thiones, dipolysulfides (e.g., dimorpholine disulfide, cystine and hexathiokane-thione), mercapto compounds (e.g., cysteine), polythionates and elemental sulfur, can be used for sulfur sensitization. In addition, active gelatin is also utilizable. Of the compounds recited above, thiosulfates, thioureas, phosphine sulfides and rhodanines are preferred over the others.

In the selenium sensitization, unstable selenium compounds are used. The unstable selenium compounds which can be used herein are disclosed in Japanese Patent Application (Laid-Open) Nos. 13489/1968, 15748/1969, 25832/1992 and 109240/1992, 271341/1992 and Japanese Patent Application No. 82929/1991. Specifically, such compounds include colloidal metallic selenium, selenoureas (such as N,N-dimethylselenourea, trifluoro-methylcarbonyltrimethylselenourea and acecyl-trimethylselenourea), selenoamides (such as selenoacetamide and N,N-diethylphenylselenoamide), phosphine selenides (such as triphenylphosphine selenide and pentafluorophenyl-triphenylphosphine selenide), selenophosphates (such as tri-p-tolylselenophosphate and tri-n-butylselenophosphate), selenoketones (such as selenobenzophenone), isoselenocyanates, selenocarboxylic acids, selenoesters and diacylselenides. In addition, moderately stable selenium compounds (as disclosed in Japanese Patent Publication Nos. 4553/1971 and 34492/1977), including selenious acid, potassium selenocyanide, selenazoles and selenides, can also be utilized for selenium sensitization.

In the tellurium sensitization, unstable tellurium compounds as disclosed in Canadian Patent No. 800,958, U.K. Patent Nos. 1,295,462 and 1,396,696, and Japanese Patent Application (Laid-Open) Nos. 204640/1992, 271341/1992, 333043/1992 and 303157/1993 can be used. Examples of such tellurium compounds include telluroureas (such as tetramethyltellurourea, N,N'-dimethylethylenetellurourea and N,N'-diphenylethylene-tellurourea), phosphine tellurides (such as butyldiisopropylphosphine telluride, tributylphosphine telluride, tributoxyphosphine telluride and ethoxydiphenylphosphine telluride), diacyl(di)tellurides (such as bis(diphenylcarbamoyl)ditelluride, bis(N-phenyl-N-methylcarbamoyl)ditelluride, bis (N-phenyl-N-methylcarbamoyl) telluride and bis(ethoxycarbonyl)telluride), isotellurocyanates, telluroamides, tellurohydrazides, telluroesters (such as butylhexyltelluroester), telluroketones (such as telluroacetophenone), colloidal tellurium, (di) tellurides and other tellurium compounds (such as potassium telluride and sodium telluropentathionate). Of these tellurium compounds, diacyl(di)tellurides and phosphine tellurides are preferred over the others.

In the gold sensitization can be used gold salts as described in, e.g., P. Glafkides, *Chimie et Physique Photographique,* 5th ed., Paul Montel (1987), and *Research Disclosure,* vol. 307, Item 307105. Examples of such gold salts include chloroauric acid, potassium chloroaurate and potassium aurithiocyanate. In addition to these gold salts, the gold compounds disclosed in U.S. Pat. No. 2,642,361 (gold sulfide and gold selenide), U.S. Pat. No. 3,503,749 (gold thiolate having water-soluble groups), U.S. Pat. No. 5,049,484 (bis(methylhydantoinato) gold complex salt), U.S. Pat. No. 5,049,485 (mesoionic thiolate-gold complex salts, such as 1,4,5-trimethyl-1,2,4-triazolium-3-thiolate-gold complex salt), the large hetero ring-gold complex salts disclosed in U.S. Pat. Nos. 5,252,455 and 5,391,727, and the gold compounds disclosed in U.S. Pat. Nos. 5,620,841, 5,700,631, 5,759,760, 5,759,761, 5,912,111, 5,912,112 and 5,939,245, and Japanese Patent Application (Laid-Open) Nos. 147537/1989, 69074/1996, 69075/1996, 269554/1997 and 29274/1970, German Patent Nos. DD-264524A, 264525A, 264574A and 298321A, Japanese Patent Application (Laid-Open) Nos. 75214/2001, 75215/2001, 75216/2001, 74217/2001 and, 75218/2001 can be used for the gold sensitization.

In the reduction sensitization can be used known reducing compounds as described in, e.g., P. Glafkides, *Chimie et Physuque Photographique,* 5th ed., Paul Montel (1987), and *Research Disclosure,* vol. 307, Item 307105. Examples of such reducing compounds include aminoiminomethanesulfinic acid (thiourea dioxide), borane compounds (such as dimethylamine borane), hydrazine compounds (such as hydrazine and p-tolylhydrazine), polyamine compounds (such as diethylene-triamine and triethylenetetramine), stannous chloride, silane compounds, reductones (such as ascorbic acid), sulfites, aldehyde compounds and hydrogen gas. In addition, reduction sensitization can be carried out in an atmosphere of high pH or excess silver ions (the so-called silver ripening).

The chemical sensitization of those kinds may be carried out independently or in combination of two or more thereof. In particular, the combination of chalcogen sensitization and gold sensitization is preferred over the others. Further, it is effective that the reduction sensitization be carried out in the step of forming silver halide grains. The amount of chalcogen sensitizers used in the present invention is determined depending on what type of silver halide grains are sensitized and what condition is adopted for the chemical sensitization. Specifically, the amount of chalcogen sensitizers used is generally from $10^{-8}$ to $10^{-2}$ mole, preferably from $10^{-7}$ to $5\times10^{-3}$ mole, per mole of silver halide. The amount of precious metal sensitizers used is generally from $10^{-7}$ to $10^{-2}$ mole per mole of silver halide. As to the conditions for chemical sensitization, there are no particular restrictions in the present invention. However, it is appropriate for the chemical sensitization that the pAg be from 6 to 11, preferably from 7 to 10, the pH be from 4 to 10, and the temperature be from 40 to 95° C., preferably 45 to 85° C.

In order to prevent fogging from occurring in photosensitive materials during the production, storage or photographic processing process, or stabilize photographic properties, it is desirable to add various compounds to the silver halide emulsion. Examples of such compounds include azoles (such as benzothiazolium salts, nitroindazoles, triazoles, benzotriazoles, imidazoles and benzimidazoles (especially nitro- or halogen-substituted benzimidazoles)), heterocyclic mercapto compounds (such as mercaptothiazole, mercaptobenzothiazoles, mercaptobenzimidazoles, mercapto-thiadiazoles, mercaptotetrazoles (especially 1-phenyl-5-mercaptotetrazole) and mercpatopyrimidines), heterocyclic mercapto compounds having the same heterocyclic moieties as recited above and further containing water soluble groups, such as carboxyl and sulfo groups, thioketo compounds (such as oxazinethione), azaindenes (such as tetrazaindenes (especially 4-hydroxy-(1,3,3a,7)tetrazaindens), benzenethiosulfonic acids and benzenesulfinic acids. In general these compounds are known as antifoggants or stabilizers.

The antifoggants or stabilizers are usually added after chemical sensitization. However, their addition timing can be chosen from the midst of chemical sensitization, or any of stages before chemical sensitization. More specifically, in the process of forming silver halide emulsion grains, the antifoggants or stabilizers may be added during the addition of a silver salt solution, in a period between the conclusion of the addition and the start of chemical sensitization, or in the course of chemical sensitization (preferably within a period between the start and 50%, particularly preferably 20%, of the time spent on chemical sensitization).

The present silver halide photographic materials have no particular restrictions as to their layer structures. When they are silver halide color photographic materials, however, they have a multi-layer structure for recording blue light, green light and red light separately. Further, each silver halide emulsion layer may be constituted of two layers, namely a high-speed layer and a low-speed layer. Examples of a practical layer structure are given below:

(1) BH/BL/GH/GL/RH/RL/S (2) BH/BM/BL/GH/GM/GL/RH/RM/RL/S (3) BH/BL/GH/RH/GL/RL/S (4) BH/GH/RH/BL/GL/RL/S (5) BH/BL/CL/GH/GL/RH/RL/S (6) BH/BL/GH/GL/CL/RH/RL/S

Herein, B stands for a blue-sensitive layer, G for a green-sensitive layer, R for a red-sensitive layer, H for a highest speed layer, M for a medium speed layer, L for a low speed layer, S for a support, and CL for an interlayer effect-providing layer. Light-insensitive layers, such as a protective layer, a filter layer, an interlayer and an anti-halation layer, are omitted from the foregoing representation of layer structures. In addition, the arranging order of high speed and low speed layers having the same color sensitivity may be reversed. The layer structure (3) is described in U.S. Pat. No. 4,184,876. The layer structure (4) is described in *Research Disclosure,* vol. 225, Item 22534, and Japanese Patent Application (Laid-Open) Nos. 177551/1984 and 177552/1984. The layer structures (5) and (6) are described in Japanese Patent Application (Laid-Open) No.34541/1986. The layer structures (1), (2) and (4) are preferred over the others. Besides color photographic materials, the present silver halide photosensitive materials can be applied to X-ray photographic materials, sensitive materials for black and white photography, sensitive materials for photomechanical process and photographic printing paper.

With respect to the gelatin hardeners, for example, active halogen compounds (such as 2,4-dichloro-6-hydroxy-1,3,5-triazine and sodium salt thereof) and active vinyl compounds (such as 1,3-bisvinylsulfonyl-2-propanol, 1,2-bis(vinylsulfonylacetamido)ethane and vinyl polymers having vinylsulfonyl groups in their chains) are used to advantage because they can quickly harden hydrophilic colloids such as gelatin to provide stable photographic characteristics. In addition, N-carbamoylpyridinium salts (such as (1-morpholinocarbonyl-3-pyridinio)methanesulfonate) and haloamidinium salts (such as 1-(1-chloro-1-pyridinomethylene)pyrrolidinium 2-naphthalenesulfonate) are also excellent hardeners because of their high hardening speed.

For various additives usable in the present silver halide emulsion (e.g., binders, chemical sensitizers, spectral sensitizers, stabilizers, gelatin, hardeners, surfactants, antistatic agents, polymer latexes, matting agents, color couplers, ultraviolet absorbents, discoloration inhibitors, dyes), supports and processing methods for photographic materials (e.g., coating methods, exposure methods, development-processing methods), the descriptions in *Research Disclosure,* vol. 176, Item 17643 (abbreviated as "RD-17643"), vol. 187, Item 18716 (abbreviated as "RD-18716") and vol. 225, Item 22534 (abbreviated as "RD-22534") can be referred to. The locations where the additives are described in each of those references are listed below.

| Kinds of Additives | RD-17643 | PD-18716 | RD-22534 |
|---|---|---|---|
| 1. Chemical sensitizer | p. 23 | p. 648, right column | p. 24 |
| 2. Sensitivity increasing agent | " | p. 648, right column | " |
| 3. Spectral sensitizer | pp. 23–24 | p. 648, right column, to p. 649, right column | pp. 24–28 |
| 4. Brightening agent | p. 24 | | |
| 5. Antifoggant and | pp. 24–25 | p. 649, right column p. 31 | p. 24 and |
| 6. Light absorbent, Filter dye, UV absorbent | pp. 25–26 | p. 649, right column, to p. 650, left column | |
| 7. Stain inhibitor | p. 25, right column | p. 650, left to right column | |
| 8. Dye image stabilizer | p. 25 | | p. 32 |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating aid, Surfactant | pp. 26–27 | p. 650, right column | |
| 13. Antistatic agent | p. 27 | p. 650, right column | |
| 14. Color coupler | p. 25 | p. 649 | p. 31 |

The color photographic materials can be processed using the general methods described in *Research Disclosure,* vol. 176, Item 17643 and ibid., vol. 187, Item 18716. Specifically, the color photographic light-sensitive materials are subjected to washing or stabilization processing usually after undergoing development processing and bleach-fix or fixation processing. In the washing step, a counter-current washing method using two or more tanks is generally adopted to effect a water saving. As a typical example of stabilization processing which can take the place of washing processing, the multistage counter-current stabilization processing as disclosed in Japanese Patent Application (Laid-Open) No. 8543/1982 can be cited.

EXAMPLE

Now, the present invention will be illustrated in more detail by reference to the following examples, but it should be understood that these examples are not to be construed as limiting the scope of the present invention in any way.

Example 1

Emulsion 1-A: Host Tabular Grain Emulsion (AgBr)

Host tabular grains were prepared in the manner described below. The mixer used for the grain preparation was the same mixer (volume: 0.5 ml) as shown in FIG. 4 of Japanese Patent Application (Laid-Open) No. 283837/1990 and the system used therein was the same system as shown in FIG. 3 of the reference cited.

<Nucleation>

In a reaction vessel 1, 2 g of low-molecular-weight ossein gelatin was added to 1.0 liter of water and dissolved therein, and then kept at 35° C. To the mixer 7, 50 ml of a 0.6M aqueous silver nitrate solution and 200 ml of 0.16M aqueous KBr solution containing 0.8 weight % of low-molecular-weight gelatin were added over a 2-minute period. The emulsion thus obtained was continuously fed to the reaction vessel over a 2-minute period. Therein, the number of revolutions for agitation in the mixer was 2,000 rpm.

<Ripening>

The emulsion in the reaction vessel was adjusted so as to have pBr of 2.1 by addition of 300 ml of a 10% trimellited gelatin solution and KBr, and then heated up to 80° C.

<Growth>

To the mixer, 1,100 ml of 1.4M aqueous silver nitrate solution and 1,100 ml of a mixed solution containing 100 g of low-molecular-weight gelatin and 1.4M of KBr were further added at a constant flow rate over a 60-minute period. The fine grains formed in the mixer were continuously fed into the reaction vessel. Therein, the number of revolutions for agitation in the mixer was 2,000 rpm.

At time of 70% addition of silver nitrate in the course of the grain growth, the grains were doped by addition of $IrCl_6$ in an amount of $8\times10^{-8}$ mole/mole Ag. Before the conclusion of the grain growth, a hexacyanoferrate (II) solution was further added to the mixer. Therein, the grains were doped with potassium hexacyanoferrate(II) so that the potassium hexacyanoferrate(II) had a local concentration of $3\times10^{-4}$ mole/mole Ag in 3%, based on the amount of silver added, of each individual shell portions thereof. After the completion of the addition, the emulsion was cooled to 35° C., and washed by the usual flocculation method. The emulsion thus washed was admixed with 350 ml of water and 70 g of lime-processed ossein gelatin, made into a solution, adjusted so as to have a pAg value of 8.7 and a pH value of 6.5, and then stored in a cool, dark place. The tabular grains thus obtained had an equivalent circle diameter of 1.9 $\mu$m, an average thickness of 0.060 $\mu$m and an average aspect ratio of 37. The proportion of tabular grains in the total emulsion grains prepared was 96% on a protected area basis. Herein, the term equivalent circle diameter means the diameter of a circle equivalent to the projected area of a tabular grain.

Emulsion 1-B (Comparison)

Epitaxial phases were formed on the tabular grains of Emulsion 1-A as follows: A portion of Emulsion 1-A equivalent to an amount of 0.3 mole in silver nitrate terms was admixed with 640 ml of distilled water, and thereto aqueous solutions respectively containing silver nitrate and potassium iodide in the same concentration were added at an addition speed of 10.5 ml/min over a 30-minute period in accordance with a double-jet method while keeping the temperature at 60° C. and the pAg value at 8.52 so that the amount of silver in the high-iodide epitaxial phases accounted for 15% of the amount of total silver. Thereafter, the emulsion obtained was washed and stored in the same manners as Emulsion 1-A.

Emulsion 1-C (Comparison)

<Formation of Silver Bromide Shell>

On each of the grains in Emulsion 1-B, a silver bromide shell was formed using the same mixer (volume: 0.5 ml) as shown in FIG. 4 of Japanese Patent Application (Laid-Open) No. 283837/1990 in the same system as shown in FIG. 3 of the reference cited under the conditions described below.

The Emulsion 1-B before washing was placed in a reaction vessel and adjusted to pAg 7.21 by addition of an aqueous solution of KBr. To the mixer, a 0.60M aqueous silver nitrate solution and 1,000 ml of a mixed solution containing 50 g of low-molecular-weight gelatin (molecular weight: $2\times10^4$) and 0.603M of KBr were added continuously at 75° C. in constant volumes so that the amount of silver added came to account for 10 mole % of the amount of total silver. The fine grain emulsion formed in the mixer were continuously fed into the reaction vessel. Therein, the number of revolutions for agitation in the mixer was 2,000 rpm. The effective stirring with the stirrer blades in the reaction vessel was performed at 800 rpm.

Emulsion 1-D (Comparison)

An emulsion as Emulsion 1-D was prepared in the same manner as Emulsion 1-B, except that the pAg was kept at 6.81 during the formation of high-iodide epitaxial phases.

Emulsion 1-E (Comparison)

An emulsion as Emulsion 1-E was prepared in the same manner as Emulsion 1-C, except that Emulsion 1-D was used in place of the Emulsion 1-B before washing.

Emulsion 1-F (Comparison)

An emulsion as Emulsion 1-F was prepared in the same manner as Emulsion 1-D, except that Compound 1 illustrated below was added before forming the high-iodide epitaxial phases.

Compound 1

Compound 1

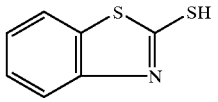

Emulsion 1-G (Invention)

An emulsion as Emulsion 1-G was prepared in the same manner as Emulsion 1-C, except that Emulsion 1-F was used in place of the Emulsion 1-C before washing.

Emulsion 1-H (Comparison):

An emulsion as Emulsion 1-H was prepared in the same manner as Emulsion 1-B, except that the pAg was kept at 5.61 during the formation of high-iodide epitaxial phases.

Emulsion 1-I (Invention):

An emulsion as Emulsion 1-I was prepared in the same manner as Emulsion 1-C, except that Emulsion 1-H was used in place of the Emulsion 1-B before washing.

In Emulsion 1-B, the high-iodide epitaxial phases were not deposited on the main surfaces of host tabular grains, but were deposited on the fringe areas and lateral faces. Therefore, Emulsion 1-B was outside the scope of the present invention. In Emulsion 1-C, silver bromide had a tendency to deposit on the main surfaces, and the lateral portion of silver bromide deposited had a composition of $AgBr_{0.6}I_{0.4}$, namely a composition high in silver iodide content. In Emulsion 1-D, epitaxial phases having iodide contents of at least 97 mole % were deposited in a shape like islands on the main surfaces, but such phases were also deposited on the lateral faces. In Emulsion 1-E, the silver bromide shell had a tendency to deposit on the main surfaces as in the case of Emulsion 1-C, and the high-iodide epitaxial phases on the main surfaces were covered with silver bromide without being exposed on the outside of the shell, or they underwent dissolution and re-crystallization to form $AgBr_{0.6}I_{0.4}$. In Emulsion 1-F, epitaxial phases having iodide contents of at least 97 mole % were deposited on the main surfaces alone, and neither fringe areas nor lateral faces. In Emulsion 1-G, the silver bromide was deposited on the lateral faces alone, the iodide contents in high-iodide epitaxial phases on the main surfaces were kept at 97 mole % and these phases were exposed on the outside. In addition, the iodide content in the lateral portion was not higher than 3 mole %. In Emulsion 1-H, epitaxial phases having iodide contents of at least 97 mole % were not deposited in a shape like islands on the main surfaces, but uniformly on the main surfaces in their entirety in a state that boundaries between adjacent epitaxial phases were lost; while on the lateral faces, no high-iodide epitaxial phases were formed. In Emulsion 1-I, as in the case of Emulsion 1-G, the silver bromide was deposited on the lateral faces alone, the iodide content in the lateral portion was not higher than 3 mole %, and the high-iodide epitaxial phases on the main surfaces were maintained and exposed on the outside.

Each of Emulsions 1-A to 1-I was admixed with Compounds 2 and 3 illustrated below, and heated up to 60° C. The resultant emulsions were each admixed with Sensitizing Dyes 1 and 2 illustrated below, and further with potassium thiocyanate, chloroauric acid, sodium thiosulfate and N,N-dimethylselenourea so that optimum chemical sensitization was achieved. At the conclusion of the chemical sensitization, Compounds 4 and 5 illustrated below were further added. The expression "optimum chemical sensitization was achieved" means that the amounts of the sensitizing dyes added and those of the compounds added were each selected from the range of $10^{-1}$ to $10^{-8}$ mole/mole of silver halide.

Compound 2

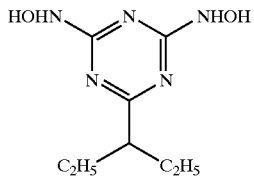

Compound 3

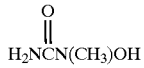

Sensitizing Dye 1

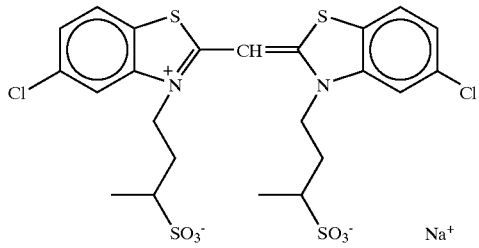

Sensitizing Dye 2

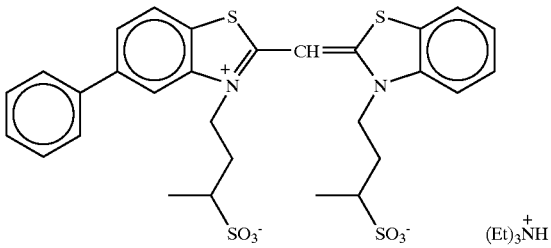

-continued

Compound 4

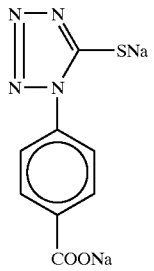

Compound 5

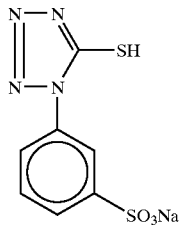

On a cellulose triacetate film support provided with a subbing layer were coated the following coating compositions for emulsion and protective layers, thereby preparing a coating sample. Additionally, Surfactant 1 illustrated below was added in a proper amount in order to better the coatability of each composition.

Surfactant 1

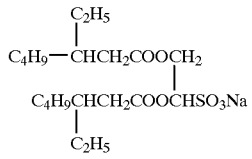

(1) Emulsion Layer

| | |
|---|---|
| Each emulsion | $3.6 \times 10^{-2}$ mole/m$^2$, based on silver |
| Coupler 1 | $1.5 \times 10^{-3}$ mole/m$^2$ |

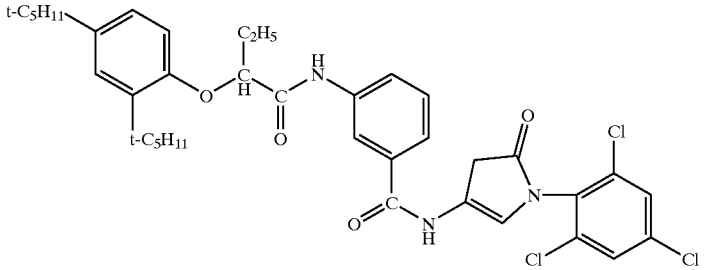

| | |
|---|---|
| Tricresyl phosphate | 1.10 g/m$^2$ |
| Gelatin | 2.30 g/m$^2$ |

(2) Protective Layer

| | |
|---|---|
| Sodium salt of 2,4-dichloro-6-hydroxy-s-triazine | 0.08 g/m$^2$ |
| Gelatin | 1.80 g/m$^2$ |

Each sample was allowed to stand for 14 hours under a condition of 40° C. and 70% relative humidity, and then subjected to 1/100-second exposure via a yellow filter and a continuous wedge, followed by the following color photographic processing.

<Color Photographic Processing>

| Step | Processing Time | Processing Temperature |
|---|---|---|
| Color development | 2 min 00 sec | 40° C. |
| Bleach-fix | 3 min 00 sec | 40° C. |
| Washing (2) | 20 sec | 35° C. |
| Washing (1) | 20 sec | 35° C. |
| Stabilization | 20 sec | 35° C. |
| Drying | 50 sec | 65° C. |

Next the compositions of processing solutions used are described.

(Color developer)

| | |
|---|---|
| Diethylenetriaminepentaacetic acid | 1.0 g |
| 1-Hydroxyethylidene-1,1-disulfone | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methyl-aniline sulfate | 4.5 g |
| Water to make | 1.0 liter |
| pH | 10.05 |

(Bleach-fix Bath)

| | |
|---|---|
| Ammonium ethylenediaminetetraacetato-ferrate (III) dihydrate | 90.0 g |
| Disodium ethylenediaminetetraacetate | 5.0 g |
| Sodium sulfite | 12.0 g |
| Aqueous ammonium thiosulfate solution (70%) | 260.0 ml |
| Acetic acid (98%) | 5.0 ml |
| Bleach accelerator 1 | 0.01 mole |

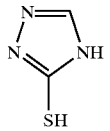

| | |
|---|---|
| Water to | 1.0 liter |
| pH | 6.0 |

(Washing Solution)

City water was passed through a mixed-bed system column packed with an H-type cation exchange resin (Amberlite IR-120B produced by Rohm & Haas Co.) and an OH-type anion exchange resin (Amberlite IR-400 produced by Rohm & Haas Co.), and thereby the calcium and magnesium ion concentrations therein were each reduced to 3 mg/l or below. Then, the ion exchanged water was admixed with 20 mg/l of sodium dichloroisocyanurate and 1.5 g/l of sodium sulfate. The pH of the resultant solution was within the range of 6.5–7.5.

(Stabilizing Solution)

| | |
|---|---|
| Formaldehyde (36%) | 2.0 ml |
| polyoxyethylene-p-monononylphenyl ether (average polymerization degree: 10) | 0.3 g |
| Disodium ethylenediaminetetraacetate | 0.05 g |
| Water to make | 1.0 liter |
| pH | 5.0–8.0 |

The sensitivity was defined as the logarithm of reciprocal of the exposure amount required for providing a density higher than the fog density by 0.1, and the sensitivities of the samples prepared herein were shown as relative values, with Emulsion 1-A being taken as 100. Similarly to the sensitivity, the maximum optical densities (Dmax) were shown as relative values. In addition, optical absorptivities of the samples prepared herein were shown as relative values, with Emulsion 1-A being taken as 100. These values are summarized in Table 1.

TABLE 1

| Emulsion | Optical absorptivity (at 427 nm) | Sensitivity | Fog | Dmax | note |
|---|---|---|---|---|---|
| 1-A (host) | 100 | 100 | 0.10 | 100 | comparison |
| 1-B | 240 | 111 | 0.05 | 68 | comparison |
| 1-C | 238 | 201 | 0.07 | 92 | comparison |
| 1-D | 380 | 107 | 0.05 | 65 | comparison |
| 1-E | 377 | 356 | 0.08 | 85 | comparison |
| 1-F | 388 | 106 | 0.06 | 65 | comparison |
| 1-G | 386 | 367 | 0.10 | 100 | invention |
| 1-H | 410 | 102 | 0.06 | 64 | comparison |
| 1-I | 401 | 380 | 0.10 | 101 | invention |

As can be seen from Table 1, Emulsions 1-B, 1-D, 1-F and 1-H, to which the silver bromide shell was not yet attached, were high in optical absorptivity, but low in both sensitivity and Dmax. Of the silver bromide shell-attached Emulsions 1-C, 1-E, 1-G and 1-I, Emulsions 1-G and 1-I wherein it was permitted to deposit silver bromide on the lateral faces and control the silver iodide content in the lateral portion to 3 mole % or below produced satisfactory results, namely they were high in both sensitivity and Dmax.

In order to evaluate development rate capability, each sample was examined for sensitivity, fog and Dmax under conditions of development times changed to 1 minute, 2 minutes and 3 minutes, respectively. The results obtained are summarized in Table 2. Therein, the sensitivities are shown as relative values, with the sensitivity of Emulsion 1-A under the condition of 2-minute development being taken as 100. As can be seen from Table 2, Emulsions 1-B, 1-D, 1-F and 1-H were inferior in both sensitivity and Dmax, and further slow in development rate. Of the silver bromide shell-attached emulsions, on the other hand, Emulsions 1-G and 1-I enabled not only elevation of sensitivity but also acceleration of development rate, and proved to be suitable for rapid processing. The rapidity of development rate achieved by the present emulsions is attributable to combination of the formation of low-iodide silver iodobromide layer on the lateral faces of host tabular grains with incorporation of chemical sensitization nuclei in the layer formed.

TABLE 2

| Emulsion | Development time (min) | Sensitivity | Fog | Dmax | note |
|---|---|---|---|---|---|
| 1-A (host) | 1 | 95 | 0.09 | 89 | comparison |
| | 2 | 100 | 0.10 | 100 | |
| | 3 | 104 | 0.10 | 103 | |
| 1-B | 1 | 77 | 0.02 | 42 | comparison |
| | 2 | 111 | 0.05 | 68 | |
| | 3 | 168 | 0.08 | 80 | |
| 1-C | 1 | 167 | 0.04 | 80 | comparison |
| | 2 | 201 | 0.07 | 92 | |
| | 3 | 238 | 0.09 | 101 | |
| 1-D | 1 | 76 | 0.01 | 40 | comparison |
| | 2 | 107 | 0.05 | 65 | |
| | 3 | 155 | 0.07 | 78 | |
| 1-E | 1 | 310 | 0.08 | 79 | comparison |
| | 2 | 356 | 0.08 | 85 | |
| | 3 | 377 | 0.09 | 101 | |
| 1-F | 1 | 80 | 0.03 | 41 | comparison |
| | 2 | 106 | 0.06 | 65 | |
| | 3 | 150 | 0.09 | 78 | |
| 1-G | 1 | 350 | 0.07 | 95 | invention |
| | 2 | 367 | 0.08 | 102 | |
| | 3 | 380 | 0.08 | 103 | |
| 1-H | 1 | 85 | 0.02 | 44 | comparison |
| | 2 | 102 | 0.04 | 65 | |
| | 3 | 131 | 0.07 | 87 | |
| 1-I | 1 | 370 | 0.07 | 96 | invention |
| | 2 | 380 | 0.08 | 105 | |
| | 3 | 400 | 0.08 | 105 | |

Example 2

Emulsion 2-A: Large-sized Host Tabular Grain Emulsion (Containing Dislocations)

A 42.2-liter of aqueous solution containing 31.7 g of KBr and 31.7 g of phthalated low-molecular-weight gelatin having a phthalation rate of 97% and a molecular weight of 15,000 was stirred vigorously while it was kept at 35° C. To this solution, 1,583 ml of an aqueous solution containing 316.7 g of $AgNO_3$ and 1.583 ml of an aqueous solution containing 221.5 g of KBr and 52.7 g of low-molecular-weight gelatin having a molecular weight of 15,000 were added over a 1-minute period in accordance with a double jet method. Immediately after the conclusion of the addition, 52.8 g of KBr was further added, and then 2485 ml of an aqueous solution containing 398.2 g of $AgNO_3$ and 2581 ml of an aqueous solution containing 291.1 g of KBr were added over 2 minutes. Immediately after the conclusion of the addition, 47.8 g of KBr was further added. Then, the reaction solution was heated up to 40° C., and ripened to a sufficient degree. At the conclusion of ripening, 79.2 g of KBr and 923 g of phthalated gelatin having a phthalation rate of 97% and a molecular weight of 100,000 were added. Subsequently thereto, 15,947 ml of an aqueous solution containing 5,130 g of $AgNO_3$ and an aqueous solution of KBr were added over a 12-minute period in accordance with a double jet method at a flow rate increased so that the final flow rate became 1.4 times the initial flow rate. During this process, the silver potential was kept at −60 mV with respect to a saturated calomel electrode. After washing, the emulsion obtained was further admixed with gelatin, and thereby adjusted to pH 5.7, pAg 8.8, a silver content of 131.8 g/kg per kg of the emulsion and a gelatin content of 64.1 g/kg per kg of the emulsion. Thus, a seed emulsion was prepared. In a reaction vessel, the seed emulsion was placed in an amount of 9.9 g, and admixed with 0.3 g of modified silicone oil (L7602, a product of NIPPON UNICAR CO., LTD.). The admixture was adjusted to pH 5.5 by addition of $H_2SO_4$, and then thereto 67.6 ml of an aqueous solution containing 7.0 g of $AgNO_3$ and an aqueous solution of KBr were added over a 6-minute period in accordance with a double jet method at a flow rate increased so that the final flow rate became 5.1 times the initial flow rate. During this process, the silver potential was kept at −20 mV with respect to a saturated calomel electrode. Thereto, 2 mg of sodium benzenethiosulfonate and 2 mg of thiourea dioxide were further added. While preparing in a mixer installed on the outside of the reaction vessel an AgBrI fine grain emulsion having an iodide content of 7 mole % (average grain size: 0.015 μm) by simultaneously adding 762 ml of an aqueous solution containing 134.4 g of $AgNO_3$ and 762 ml of an aqueous solution containing 90.1 g of KBr, 9.46 g of KI and 38.1 g of gelatin having a molecular weight of 20,000, the AgBrI fine grain emulsion prepared was fed into the reaction vessel over a 90-minute period. During the feeding of the fine grain emulsion, the silver potential was kept at −30 mV with respect to a saturated calomel electrode. Furthermore, 121.3 ml of an aqueous solution containing 45.6 g of $AgNO_3$ and an aqueous solution of KBr were added over a 22-minute period in accordance with a double jet method. Therein, the silver potential was kept at +20 mV. Then, the temperature was raised to 82° C., and the silver potential was lowered to −80 mV by addition of KBr. Thereafter, an AgI fine grain emulsion having a grain size of 0.037 μm was added in an amount of 6.33 g, based on the weight of KI. Immediately after the addition, 206.2 ml of an aqueous solution containing 66.4 g of $AgNO_3$ was added over a 16-minute period. For 5 minutes at the initial stage of the addition, the silver potential was kept at −80 mV by addition of an aqueous KBr solution. After washing, the resulting emulsion was adjusted to pH 5.8 and pAg 8.7 at 40° C. through addition of gelatin. The thus obtained tabular grains had an average equivalent sphere diameter of 1.7 μm, an average equivalent circle diameter of 3.1 μm, an average thickness of 0.33 μm and an average aspect ratio of 9.5. In the subsequent process, the tabular grain emulsion thus obtained was subjected to the same treatments as Emulsion A-1. In addition, the emulsion underwent optimum reduction sensitization during the grain growth.

From observation of the thus obtained tabular grains under a transmission electron microscope with the liquid-nitrogen cooling, it was found that 99.8%, on a number basis, of the total grains were grains containing no dislocations within the grain's central area equivalent to 80%, based on the projected area. And these grains contained an average of 12 dislocation lines per grain in their respective peripheral areas equivalent to 20%, based on the projected area.

Emulsion 2-B (Comparison)

An emulsion as Emulsion 2-B was prepared in the same manner as Emulsion 1-H, except that Emulsion 2-A was used in place of Emulsion 1-A.

Emulsion 2-C (Invention)

An emulsion as Emulsion 2-C was prepared in the same manner as Emulsion 1-I, except that Emulsion 2-B was used in place of Emulsion 1-H.

Emulsion 2-D Large-Sized Host Tabular Grain Emulsion (Free of Dislocations)

An emulsion as Emulsion 2-D was prepared in the same manner as Emulsion 2-A, except that the addition of fine-grain silver iodide and the subsequent addition of silver nitrate were not carried out.

From observation of the thus obtained tabular grains under a transmission electron microscope with the liquid-nitrogen cooling, it was found that dislocation line was absent from not only central area but also peripheral area of the grains each.

Emulsion 2-E (Comparison)

An emulsion as Emulsion 2-E was prepared in the same manner as Emulsion 1-H, except that Emulsion 2-D was used in place of Emulsion 1-A.

Emulsion 2-F (Invention)

An emulsion as Emulsion 2-F was prepared in the same manner as Emulsion 1-I, except that Emulsion 2-E was used in place of Emulsion 1-H.

As to the grain shape, the same results as in Example 1 were obtained. More specifically, the grains in Emulsion 2-B had deposits of high-iodide epitaxial phases on the main surfaces, but the iodide content in the lateral part thereof was a high value of 35 mole %. In Emulsion 2-C, on the other hand, the fine grains of silver bromide added were deposited on the lateral faces and the iodide content in the lateral part of the grains was lowered to 3 mole % or below. As in the case of Emulsion 2-C, Emulsion 2-F enabled reduction of an iodide content to 3 mole % or below in the lateral part of the grains in Emulsion 2-E.

As a result of subjecting each of those emulsions to the same chemical sensitization, coating, exposure and photographic processing operations as in Example 1, it was found that both Emulsion 2-C and Emulsion 2-E were satisfactory in all the characteristics: sensitivity, fog and Dmax. In particular, Emulsion 2-C attained more increase in sensitivity because dislocation lines were present in the peripheral areas of the host tabular grains.

The development rate of each emulsion was evaluated in the same way as in Example 1. And the evaluation results obtained are shown in Table 3. Emulsion 2-C and Emulsion 2-F made very rapid development rate, compared with Emulsion 2-B and Emulsion 2-E, respectively. The speedup in development rate which resulted from the difference in lateral iodide content was more pronounced in Example 2 than in Example 1.

TABLE 3

| Emulsion | Development time (min) | Sensitivity | Fog | Dmax | note |
|---|---|---|---|---|---|
| 2-A (host with dislocations) | 1 | 80 | 0.08 | 70 | comparison |
| | 2 | 100 | 0.09 | 100 | |
| | 3 | 104 | 0.09 | 124 | |
| 2-B | 1 | 50 | 0.01 | 31 | comparison |
| | 2 | 111 | 0.05 | 58 | |
| | 3 | 221 | 0.09 | 84 | |
| 2-C | 1 | 309 | 0.07 | 79 | invention |
| | 2 | 339 | 0.07 | 98 | |
| | 3 | 380 | 0.08 | 99 | |
| 2-D (host without dislocations) | 1 | 47 | 0.08 | 91 | comparison |
| | 2 | 63 | 0.08 | 102 | |
| | 3 | 89 | 0.09 | 105 | |
| 2-E | 1 | 81 | 0.01 | 40 | comparison |
| | 2 | 115 | 0.04 | 69 | |
| | 3 | 162 | 0.07 | 96 | |
| 2-F | 1 | 303 | 0.0/ | 89 | invention |
| | 2 | 340 | 0.08 | 97 | |
| | 3 | 381 | 0.08 | 99 | |

Example 3

Emulsion 3-A (Invention)

An emulsion as Emulsion 3-A was prepared in the same manner as Emulsion 2-B, except that 0.05% of thiourea dioxide was added at time of 30 minutes in advance of the addition of the aqueous $AgNO_3$ solution and the aqueous KI solution, a 0.1% solution of $C_2H_5SO_2SNa$ was added in a proper amount at the time when 30% addition of the aqueous $AgNO_3$ solution finished and optimum reduction sensitization was effected.

Emulsion 3-B (Invention)

An emulsion as Emulsion 3-B was prepared in the same manner as Emulsion 2-C, except that Emulsion 3-A was used in place of Emulsion 2-A.

As a result of subjecting the emulsion to the same chemical sensitization, coating, exposure and photographic processing operations as in Example 1, it was found that Emulsion 3-B became rapid in development rate, compared with Emulsion 3-A, and besides, both sensitivity and fog thereof compared advantageously with those of Emulsion 2-C.

Example 4

After preparing an emulsion in the same manner as Emulsion 3-A, the emulsion was heated up to 60° C. Thereto, Sensitizing Dyes 1 and 2 were added, and then potassium thiocyanate, bis(1,4,5-trimethyl-1,2,4-triazolium-3-thiolato)gold(I) tetrafluoroborate, carboxymethyltrimethylthiourea and N,N-dimethylselenourea were added so as to achieve optimum chemical sensitization. At the conclusion of the chemical sensitization, Compounds 4 and 5 were added.

Example 5

The same emulsion as Emulsion 2-C prepared in Example 2 was subjected to optimum chemical sensitization, and further to spectral sensitization. The resulting emulsion was used as the emulsion for the third layer of the sensitive material as Sample 201 prepared in Example 1 of Japanese Patent Application (Laid-Open) No. 146237/1997, and the resulting sensitive material underwent the same photographic processing as in Examples of the reference to produce good results.

Example 6

The same emulsion as Emulsion 2-C prepared in Example 2 was subjected to optimum chemical sensitization, and further to spectral sensitization. The thus sensitized emulsion was used as the emulsion for the third layer of the sensitive material as Sample 110 prepared in Example 1 of Japanese Patent Application (Laid-Open) No. 20462/1998. The sensitive material obtained was subjected to the same photographic processing as in Examples of the reference to produce good results.

Example 7

Seed Emulsion

A seed emulsion was prepared according to the preparation method of silver halide tabular grains as described in Example 2 of Japanese Patent Application (Laid-Open) No. 293372/1998. More specifically, one liter of a dispersion medium solution containing 0.54 g of NaCl and 0.5 g of low-molecular-weight gelatin (molecular weight: 15,000) was placed in a reaction vessel, and kept at 40° C. with stirring. Thereto, 20 ml of an aqueous solution containing 0.29 mole/l of silver nitrate and 20 ml of an aqueous solution containing 0.29 mole/l of halides at a KBr/NaCl ratio of 80/20 by mole were added simultaneously over a 40-second period. Thereafter, 25.8 ml of a 10% KBr solution was added, and the temperature was raised to 75° C. Then, an aqueous gelatin solution (60° C.) containing 35 g of trimellited gelatin and 250 ml of water was added to the dispersion medium solution. Therein, the pH was adjusted to 6.0. Further, an aqueous solution containing 1.2 mole/l of silver nitrate and an aqueous solution containing 1.2 mole/l of KBr were added simultaneously. Simultaneously with this addition, fine grains of silver iodide were added in an amount that the proportion of silver iodide to the silver nitrate added reached 10 mole %. During the addition, the pBr of the dispersion medium was kept at 2.64. After washing, the medium was mixed with gelatin, and adjusted to pH 5.7, pAg 8.8, a silver content of 131.8 g per kg of the emulsion and a gelatin content of 64.1 g per kg of the emulsion. Thus, a seed emulsion was obtained. In the emulsion obtained, the grains having the silver iodide content of 10 mole %, the equivalent sphere diameter of 0.7 $\mu$m and an aspect ratio of 28 accounted for 97% of total projected area.

Emulsion 7-A (Comparison)

In a reaction vessel, 1,211 ml of an aqueous solution containing 46 g of trimellited gelatin having a trimellitation rate of 97% and 1.7 g of KBr was placed and kept at 75° C. with vigorous stirring. Thereto, the seed emulsion described above was added in an amount of 48 g, and then 0.3 g of modified silicone oil (L7602, a product of NIPPON UNICAR CO., LTD.) was added. And the resultant solution was adjusted to pH 5.5 by addition of $H_2SO_4$. Thereto, 67.6 ml of an aqueous solution containing 7.0 g of $AgNO_3$ and an aqueous solution of KBr-KI mixture containing 10 mole % of KI were added over a 6-minute period in accordance with a double jet method at a flow rate increased so that the final flow rate became 5.1 times the initial flow rate. During this process, the silver potential was kept at +0 mV with respect to a saturated calomel electrode. Thereto, 2 mg of sodium benzenethiosulfonate and 2 mg of thiourea dioxide were further added. While preparing in a mixer installed on the outside of the reaction vessel an AgBrI fine grain emulsion having an iodide content of 10 mole % (average grain size: 0.015 $\mu$m) by simultaneously adding 762 ml of an aqueous solution containing 170 g of $AgNO_3$ and 762 ml of an aqueous solution containing 107.1 g of KBr, 16.6 g of KI and 76.2 g of gelatin having a molecular weight of 20,000, the AgBrI fine grain emulsion prepared was fed into the reaction vessel over a 120-minute period. (Thus, the core part of host tabular grains was prepared). Thereafter, 131 ml of an aqueous solution containing 58.5 g of $AgNO_3$ and an aqueous solution of KBr were added over a 30-minute period in accordance with a double jet method (thereby forming the shell part of host tabular grains). For 20 minutes from the start of the addition, the silver potential was kept at +100 mV with respect to a saturated calomel electrode, and for the rest 10 minutes the silver potential was kept at +150 mV with respect to a saturated calomel electrode. The thus formed host tabular grains had an equivalent sphere diameter of 1.7 μm and an average thickness of 0.12 μm. Subsequently thereto, under conditions that the temperature was raised to 60° C. and the silver potential was maintained at +150 mV, aqueous silver nitrate and potassium iodide solutions having the same concentration were added at a flow rate of 10.5 ml/min in accordance with a double-jet method until the amount of silver added came to account for 12 mole % of the total silver, thereby forming epitaxial phases having a high iodide content on the tabular grains. After washing, the emulsion was adjusted to pH 5.8 and pAg 8.7 at 40° C. through addition of gelatin, and then stored. Thereafter, the resulting emulsion was admixed with Compounds 1 and 2, heated up to 60° C., and further admixed with Sensitizing Dyes 1 and 2, and then subjected to optimum chemical sensitization through addition of potassium thiocyanate, chloroauric acid, sodium thiosulfate and N,N-dimethylselenourea. At the conclusion of the chemical sensitization, Compounds 3 and 4 were further added. The expression "optimum chemical sensitization" means that the sensitizing dyes and the compounds were each added in an amount selected from the range of $10^{-1}$ to $10^{-8}$ mole/mole of silver halide.

Emulsion 7-B (Invention)

An emulsion as Emulsion 7-B was prepared in the same manner as Emulsion 7-A, except that the high-iodide epitaxial phases were formed immediately after the formation of the core part of the host tabular grains and then a shell part of the host tabular grains was formed in the following manner. The shell part was formed while adding a 0.60 M aqueous silver nitrate solution and 1,000 ml of a 0.603 M aqueous KBr solution containing 50 g of low-molecular-weight gelatin (mean molecular weight: $2\times10^4$) at a constant flow rate under a temperature of 75° C. until the amount of silver added came to account for 20% of the total silver by use of the same mixer installed on the outside of the reaction vessel as described above. Therein, the fine grain emulsion prepared in the mixer was fed continuously to the reaction vessel. The number of revolutions for stirring in the mixer was 2,000 rpm. The appropriate stirring with the stirrer blades in the reaction vessel was performed at 800 rpm.

Emulsion 7-C (Invention)

An emulsion as Emulsion 7-C was prepared in the same manner as Emulsion 7-B, except that low-iodide epitaxial phases equivalent to 9.3 mole % of the total silver were formed on the corners of the host tabular grains as follows: Immediately after preparing Emulsion 7-B, the emulsion was kept at 50° C., admixed with Sensitizing Dyes 1 and 2, and then admixed with an aqueous NaCl solution and an aqueous $AgNO_3$ solution, and further heated up to 60° C., followed by addition of AgBr fine grains. Formation of these corner epitaxial phases was carried out in the presence of $K_4[RuCN_6]$. The sensitizing dyes were added for stabilization of the epitaxial phases.

In each of Emulsions 7-A, 7-B and 7-C, epitaxial phases having a high silver iodide content of 97% were deposited on the main surfaces of grains. As a result of measuring iodide contents in lateral portions of host tabular grains by EPMA, it was found that the compositions of the lateral portions were $AgBr_{0.6}I_{0.4}$ in Emulsion 7-A and $AgBr_{0.97}I_{0.03}$ in both Emulsions 7-B and 7-C.

Each of those emulsions underwent the same coating, exposure and photographic processing operations as in Example 1. The results obtained are shown in Table 4.

As can be seen from Table 4, Emulsion 7-B wherein the shell (low-iodide silver iodobromide phase) was attached after forming the high-iodide epitaxial phases had high sensitivity and high Dmax and produced good results, compared with Emulsion 7-A. And Emulsion 7-C wherein the corner epitaxial phase was further formed produced better results than Emulsion 7-B. Further, the development rate was also evaluated in addition to the sensitivity as in Example 1. The ranking of the evaluation results obtained, from worst to best, was Emulsion 7-A, Emulsion 7-B, and Emulsion 7-C.

TABLE 4

| Emulsion | Sensitivity | Fog | Dmax | note |
|---|---|---|---|---|
| 7-A | 100 | 0.02 | 100 | comparison |
| 7-B | 330 | 0.07 | 321 | invention |
| 7-C | 360 | 0.09 | 344 | invention |

Effect of the Invention

In accordance with the present invention, sensitivity can be increased by taking advantage of strong absorption the high-iodide phases have in a blue portion having a short wavelength, and silver halide emulsions ensuring rapid development rate can be provided.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising silver halide grains which each have a host tabular grain part and a part grown on the outside thereof, wherein in said host tabular grains parts, at least 50% of total projected area of the silver halide grains are accounted for by silver halide tabular grains having {111} main surfaces, and said silver halide grains comprises the main surface of the host tabular grain part subjected to junction with high-iodide epitaxial phases comprising silver halide containing at least 97 mole % of silver iodide and the lateral face of the host tabular grain part comprises silver halide having an iodide content of substantially 5 mole % or below.

2. The silver halide emulsion as in claim 1, wherein an inner part occupying less than 80% of the total silver from the center in the host tabular grain part has an average silver iodide content of at least 5 mole % and an outer part surrounding the inner part has an average silver iodide content of 5 mole % or less, and a difference in silver iodide content between the inner part and the outer part is in the range of 0 to 10 mole %.

3. The silver halide emulsion as described in claim 1, wherein the host tabular grain part has dislocation lines in an outer region situated far from the center thereof by 80% or more of a distance between the center and the periphery of the grain part, and wherein grains having the dislocation lines occupy at least 90% of the total grains.

4. The silver halide emulsion as in claim 1, wherein an amount of silver contained in the high-iodide epitaxial phases accounts for at least 10 mole % of total amount of silver.

5. The silver halide emulsion as in claim 1, wherein an occupying areal proportion of the high-iodide epitaxial phases subjected to junction onto the main surfaces of the host tabular grain part is within ±10% of an average occupying areal proportion for all the grains.

6. The silver halide emulsion as in claim 1, wherein the silver halide grains have a corner portion subjected to epitaxial junction with the silver halide phases having iodide contents of substantially 10 mole % or below.

7. A method of preparing a silver halide photographic emulsion comprising silver halide grains which each have a host tabular grain part and a part grown on the outside thereof, wherein in said host tabular grains parts, at least 50% of total projected area of the silver halide grains are accounted for by silver halide tabular grains having {111} main surfaces, and said silver halide grains comprises the main surface of the host tabular grain part subjected to junction on the main surfaces with high-iodide epitaxial phases comprising silver halide containing at least 97 mole % of silver iodide and the lateral face of the host tabular grain part comprises silver halide having an iodide content of substantially 5 mole % or below; and wherein said high-iodide epitaxial phases are formed under the following conditions (1) and/or (2) and then silver halide phases with low silver iodide contents are disposed on the lateral face of the tabular grains:

(1) pAg is maintained to less than 6.4, and (2) a compound having (100) face selectivity is present.

8. A method of preparing a silver halide photographic emulsion comprising silver halide grains which each have a host tabular grain part and a part grown on the outside thereof, wherein in said host tabular grains parts, at least 50% of total projected area of the silver halide grains are accounted for by silver halide tabular grains having {111} main surfaces, and said silver halide grains comprises the main surface of the host tabular grain part subjected to junction on the main surfaces with high-iodide epitaxial phases comprising silver halide containing at least 97 mole % of silver iodide and the lateral face of the host tabular grain part comprises silver halide having an iodide content of substantially 5 mole % or below; and wherein grain growth of at least 10% of the host tabular grain part, based on silver, is performed in a vessel by adding thereto fine grains of silver iodobromide formed in a vessel other than the vessel in which the grain growth is performed.

* * * * *

UNITED STATES PATENT AND TRADEMARK OFFICE

CERTIFICATE OF CORRECTION

PATENT NO. : 6,797,459 B2
DATED : September 28, 2004
INVENTOR(S) : Masashi Shirata It is certified that error appears in the above-identified patent and that said Letters Patent is hereby corrected as shown below:

Column 28,
Lines 42-53, should read:
1. A silver halide emulsion comprising silver halide grains which each have a host tabular grain part and a part grown on the outside thereof, wherein in said host tabular grains parts, at least 50 % of total projected area of the silver halide grains are accounted for by silver halide tabular grains having (l l l) main surface, said silver halide grains comprise the main surface of the host tabular grain pan subjected to junction with high-iodide epitaxial phases comprising silver halide containing at least 97 mole % of silver iodide and the lateral face of the host tabular grain part comprises silver halide having an iodide content of substantially 5 mole % or below and the host tabular grain part comprises high silver iodide-content surface lavers and low silver ixodide-content surface layers formed on the fringes of the high silver iodide-content surface layers, and a ratio of the main surface exposed in the high silver iodide-content surface lavers to the main surface exposed in the low silver iodide-content surface layers is from 2/1 to 9/1 on an area basis.

Lines 62-67, should read:
3. A silver halide emulsion comprising silver halide grains which each have a host tabular grain part and a part grown on the outside thereof, wherein in said host tabular grains parts at least 50 % of total projected area of the silver halide grains are accounted for by silver halide tabular grains having {l l l} main surfaces, said silver halide grains comprise the main surface of the host tabular grain part subjected to junction with high-iodide epitaxial phases comprising silver halide containing at least 97 mole % of silver iodide and the lateral face of the host tabular grain pan comprises silver halide having an iodide content of substantially 5 mole % or below and the host tabular grain part has dislocation lines in an outer region situated far from the center thereof by 80% or more of a distance between the center and the periphery of the grain part, and wherein grains having the dislocation lines occupy at least 90 % of the total grains.

Column 29,
Lines 10-12, should read:
6. The silver halide emulsion as in claim I, wherein the silver halide grains have a corner portion subjected to epitaxial junction with the silver halide phases having iodide contents of substantially 10 mole % or below.

UNITED STATES PATENT AND TRADEMARK OFFICE

CERTIFICATE OF CORRECTION

PATENT NO. : 6,797,459 B2
DATED : September 28, 2004
INVENTOR(S) : Masashi Shirata It is certified that error appears in the above-identified patent and that said Letters Patent is hereby corrected as shown below:

Column 30,
Line 25, please add:
-- 9. The silver halide emulsion as in claim 3, wherein an inner pan occupying less than 80% of the total silver from the center in the host tabular grain part has an average silver iodide content of at least 5 mole % and an outer part surrounding the inner part has an average silver iodide content of 5 mole % or less, and a difference in silver iodide content between the inner part and the outer part is in the range of 0 to 10 mole %.
10. The silver halide emulsion as in claim 3, wherein an amount of silver contained in the high-iodide epitaxial phases accounts for at least 10 mole % of total amount of silver.
11. The silver halide emulsion as in claim 3, wherein an occupying areal proportion of the high-iodide epitaxial phases subjected to junction onto the main surfaces of the host tabular grain part is within ± 10 % of an average occupying areal proportion for all the grains.
12. The silver halide emulsion as in claim 3, wherein the silver halide grains have a corner portion subjected to epitaxial junction with the silver halide phases having iodide contents of substantially 10 mole % or below. --

Signed and Sealed this

Tenth Day of May, 2005

JON W. DUDAS
*Director of the United States Patent and Trademark Office*